US005117635A

United States Patent [19]

Blau

[11] Patent Number: 5,117,635

[45] Date of Patent: Jun. 2, 1992

[54] HIGH POWER DENSITY PROPULSION/POWER SYSTEM FOR UNDERWATER APPLICATIONS

[75] Inventor: Alfred Blau, Lyndhurst, Ohio

[73] Assignee: Westinghouse Electric Corp., Pittsburgh, Pa.

[21] Appl. No.: 563,400

[22] Filed: Aug. 6, 1990

[51] Int. Cl.[5] ..... F01K 9/00; F01K 15/04

[52] U.S. Cl. ..... 60/668; 60/688; 60/689; 114/20.2

[58] Field of Search ..... 114/20.2; 60/649, 673, 60/688, 689, 690, 692, 668, 669

[56] References Cited

U.S. PATENT DOCUMENTS

| | | | |
|---|---|---|---|
| 3,831,667 | 8/1974 | Kilgore et al. | 60/688 X |
| 3,935,902 | 3/1976 | Heller et al. | 60/688 X |
| 4,637,213 | 1/1987 | Lobell et al. | 60/668 |
| 4,698,974 | 10/1987 | Wood | 60/668 X |

FOREIGN PATENT DOCUMENTS

| | | | |
|---|---|---|---|
| 933570 | 8/1963 | United Kingdom | 114/20.2 |

*Primary Examiner*—Allen M. Ostrager
*Attorney, Agent, or Firm*—D. Schron

[57] ABSTRACT

A unique arrangement of components comprising an open Rankine cycle power system for under water application is provided. The arrangement features a high energy density steam generator, a turbine, pumps and other apparatus to provide and control the flow of a seawater working fluid and the use of a mixing condenser to condense the spent steam. The mixing condenser uses droplets of seawater to condense the steam exhausted from the turbine. Alternatively, the steam may be introduced into a pool of water in the mixing condenser by means of a bubble device. The mixing condenser also provides a preheated feedwater supply for the boiler. This system facilitates the packaging of power sources an order of magnitude more powerful than current sources. Moreover, this system can be installed in current vehicles.

39 Claims, 5 Drawing Sheets

HIGH POWER DENSITY PROPULSION/POWER SYSTEM FOR UNDERWATER APPLICATIONS

BACKGROUND OF THE INVENTION

1. Field of the Invention

This invention relates to the field of propulsion systems and more particularly to the field of propulsion systems for torpedos and other underwater applications.

2. Description of the Prior Art

Recent torpedo propulsion system designs feature a closed Rankine cycle using purified water as the working fluid. These systems are commonly referred to as Stored Chemical Energy Propulsion systems (SCEPS). During the condensing portion of this cycle, heat is rejected to the ambient seawater by means of a conventional shell heat exchanger incorporated into the torpedo hull. The available volume and surface area of the largest condenser that can be packaged into a given vehicle dictates the maximum power of the propulsion system that can be incorporated in that vehicle.

FIG. 1 is a schematic diagram of a prior art torpedo propulsion system 10 based on the SCEPS totally closed concept. The thermodynamic cycle is based on a closed Rankine cycle scheme, similar to the MK 50 torpedo propulsion system, without regeneration for the feedwater. The energy required in the boiler 12 for steam generation is provided by the reaction heat of Lithium metallic fuel with gaseous sulfur hexafluoride ($SF_6$) oxidizer. The fuel and the reaction products are retained within the boiler internal cavity during the life of the system. The liquid oxidant is carried on board in a separate tank 14 which is steam heated to produce the gaseous reactant for the boiler 12. The power required to operate the drive shaft 16 for propulsion, feedwater pump 18 and accessories such as hydraulic pump 20 and alternator and air pump 22, is provided by a steam turbine 24 via a gearbox 26. The heat is rejected from the cycle, as the exhaust steam from the turbine 24 is desuperheated, condensed and subcooled. These processes are performed in the passages of the condenser 28 integral with the torpedo/vehicle hull. Propulsion system performance is highly dependent on the condensing pressure level and heat transfer area and effectiveness of the surface condenser 28.

Presently, there is a desire to increase power, and hence speed, for existing torpedo configurations. For a given power system volume this dictates the need for higher power density systems than exist today.

A closed Rankine cycle system for the desired high power levels, may not be practical. Present SCEPS systems utilize condensers which are integral with the torpedo hulls. To satisfy these high power levels, the vehicle must have a greater hull surface area exposed to the sea than is available from the full length of the torpedo hulls. Consequently, the closed Rankine cycle propulsion system may not be able to provide sufficient power to satisfy future demands.

FIG. 2 shows an alternative prior art propulsion system. FIG. 2 is a schematic drawing of an open Rankine cycle system 50 operating with seawater working fluid. The components of this system are similar to the ones shown for the closed Rankine cycle 10 with the exception of the condenser 28 of the closed cycle 10. The spent steam from the turbine 52 of open cycle 50 is either directly exhausted into the ocean via a discharge line 54 or is bypassed to oxidant tank 56 to preheat the oxidant prior to being exhausted into the ocean via discharge line 58. Therefore, a condenser is not required. The water for the feedwater pump is taken directly from the surrounding ocean via water feed line 60. The ocean pressure provides the turbine's backpressure at discharge line 54. This has a considerable effect on the available energy and conversion efficiency of the turbine 52. As a consequence, as the torpedo operational depth increases and the corresponding backpressure at discharge line 54 increases, the cycle efficiency decreases dramatically.

In an open Rankine cycle power generation scheme, the heat rejection limitation of the closed Rankine cycle system does not exist because the ocean can be considered an unlimited heat sink. However, the thermodynamic efficiency of the open Rankine cycle system becomes very poor due to backpressure on the turbine exhaust as operating ambient pressure increases. To overcome the back pressure effects in meeting mission requirements, a prohibitively large supply of propellant must be provided on board the vehicle. Additionally, the increase in heat energy generation rate requires an increase of heat transfer surfaces, leading to a larger boiler component than may be needed with a good cycle efficiency.

Neither the closed Rankine cycle nor the open Rankine cycle propulsion system will likely meet desired higher power requirements at all operating depths. Consequently, there is a need for a propulsion system that combines the increased power producing capability of the open Rankine cycle and the efficiency of the closed Rankine cycle.

SUMMARY OF THE INVENTION

To increase the power for torpedo or other underwater Rankine cycle systems, an open Rankine cycle system having a mixing condenser subsystem is provided. A Rankine cycle with this new subsystem offers high cycle efficiency and the needed heat rejection capability to produce an order of magnitude higher power density than exists in present torpedo propulsion system designs.

The propulsion system of the present invention features an open Rankine cycle utilizing seawater as the working fluid. A liquid metal combustion boiler incorporated in the system receives the working fluid and converts it into high pressure, high temperature steam. The steam is supplied to a steam turbine. The turbine converts some of the available steam energy to shaft power. The turbine's shaft output provides both the primary torpedo propulsion requirements and the direct or indirect drive needs of various accessory devices.

The spent steam is exhausted from the turbine into a mixing condenser where it is combined with seawater and thus condensed back to water. For example, seawater coolant pumped into the condenser via spray injectors may impinge on the incoming spent steam. Alternatively, the exhaust steam may be injected into a pool of seawater present in the condensing cavity. The steam is broken up into small bubbles by a steam injecting device upon injection. Mixing of the seawater coolant and the steam produces the required condensation in both cases. A portion of the steam exhausted from the turbine is used to pre-heat the oxidant which enters the boiler. This steam is then directed into the condenser.

Preferably, baffles are provided in the condenser's cavity to provide further mixing of the spent steam and coolant. The baffles also assure continuity of liquid flow for the water feed pump under various pitch and roll conditions of the vehicle.

DETAILED DESCRIPTION OF THE PREFERRED EMBODIMENT

Figure 3:
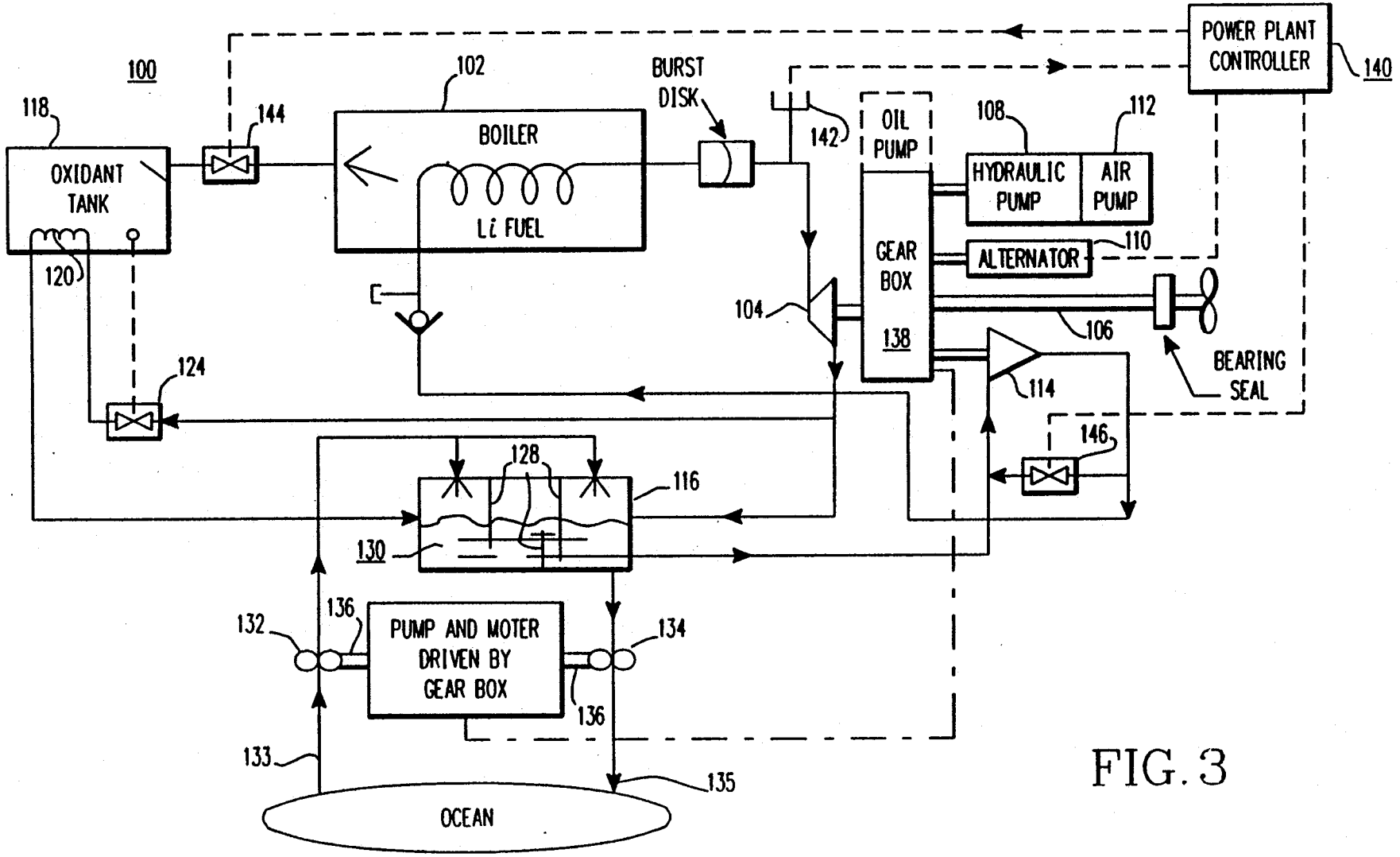
FIG. 3 is a schematic representation of a presently preferred open Rankine cycle propulsion system according to the present invention.

FIG. 3 is a schematic of system 100 including the present invention. The system 100 employs a steam generator, such as a SCEPS type boiler 102, to generate steam which is used in a prime mover device, such as steam turbine 104, to generate power to a shaft 106 for providing propulsion and for operating various accessories such as hydraulic pump 108, alternator 110, air pump 112, and feedwater pump 114.

Figure 1:
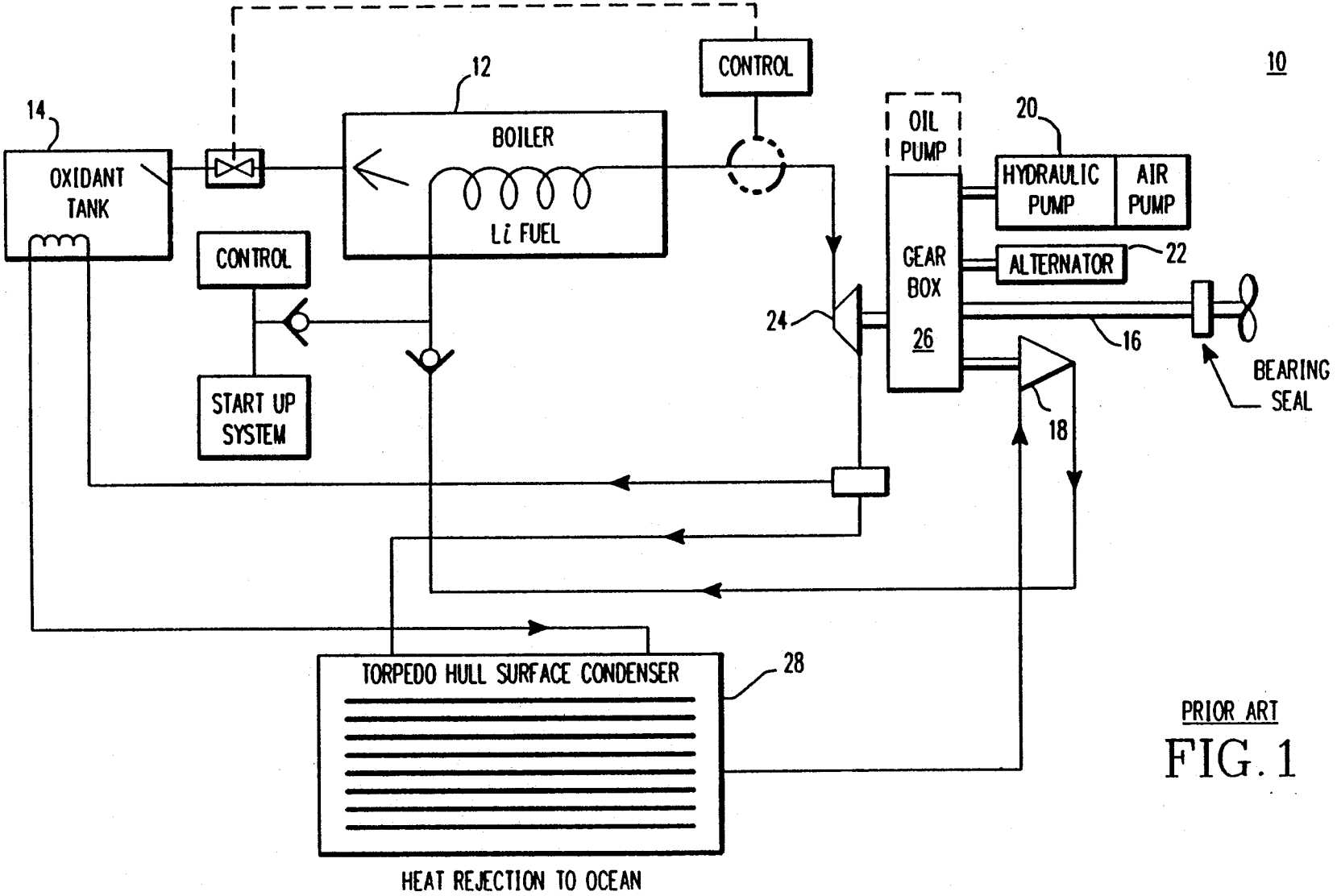
PRIOR ART FIG. 1
FIG. 1 is a schematic representation of a closed Rankine cycle propulsion system of the prior art.
Figure 2:
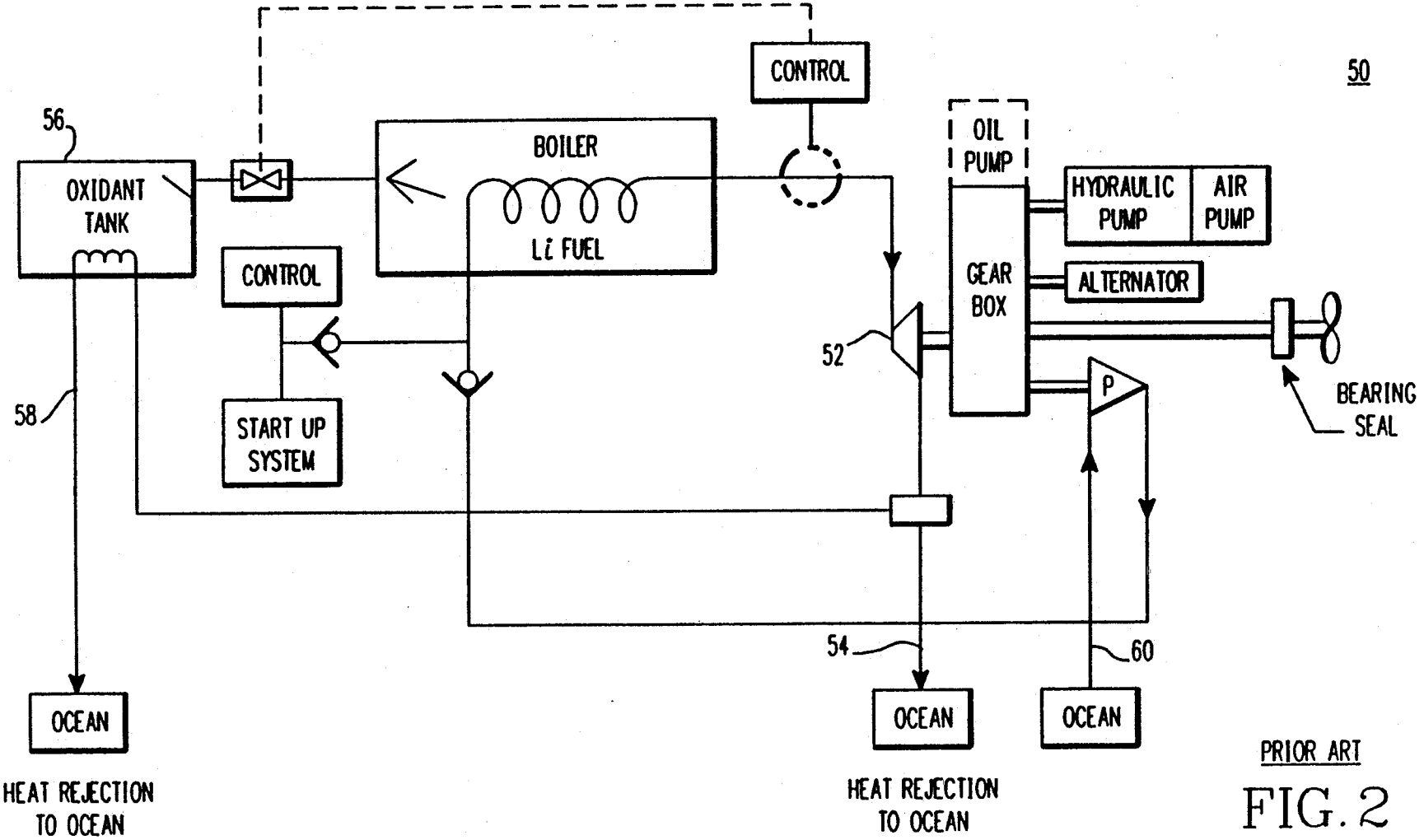
PRIOR ART FIG. 2
FIG. 2 is a schematic representation of an open Rankine cycle propulsion system of the prior art.

FIG. 3 shows a new unique mixing condenser subsystem 116 added to the open cycle steam turbine system of FIG. 2. This new condensing system 116 receives the spent steam from the exhaust of turbine 104 and provides constant, relatively low backpressure for the turbine 104 and regenerative heating of the boiler 02 feedwater. This results in high turbine 104 and thermodynamic cycle efficiency.

Oxidant tank 118 contains liquid and gaseous $SF_6$ which is used to oxidize the lithium metallic fuel in boiler 102. Oxidant heater 120, which receives a portion or all of the spent steam exhausted from turbine 104, supplies sufficient heat to the oxidizer to provide adequate gas flow rate for the boiler 102. Temperature sensor 122 provided in oxidant tank 118 facilitates regulation of the flow of steam entering oxidant heater 20 by opening and closing valve 124.

The condenser provides preheating of the feedwater for boiler 102 relative to the 32° F. ambient feedwater condition. This represents a high equivalent regenerative effectiveness.

Operation of the system 100 is based on injecting ambient seawater 126 into the exhaust steam of turbine 104 to produce condensation. Using small diameter water droplets, the condensation process is very fast, requiring a small condensing cavity. The proper amount of coolant flow is established for the cycle flow rate by a heat balance. Baffles 128 provided in the cavity 130 of condenser 116 provide adequate residence time for generally complete steam condensation even during vehicle maneuvering. The system feed-water pump 114 continuously receives the condensate water and produces high pressure flow rates for the boiler 102 according to the vehicle power needs.

The coolant injection and removal system of one presently preferred embodiment includes condenser 116 with a positive displacement fluid motor 132 which meters seawater 126 into condenser 116 through intake line 133 and pump 134 which expels working fluid from condenser 116 into the ambient sea 126 through discharge line 135. Motor 132 and pump 134 may be mounted on a common shaft 136 coupled to the turbine 104 through gearbox 138. Alternatively, direct drive means can be used in place of gearbox 138. Operating synchronously, a perfect motor 132 and pump 134 with identical displacements would produce equal flow of sea water coolant into and out of the condenser cavity 130 without any power consumption. The operating pressure differentials between the sea 126 and condenser 116 are the same for the fluid motor 132 and pump 134, however, with opposing signs. Thus, the power produced by motor 132 theoretically equals the needs of the pump 134. In reality, some power is needed, such as from the turbine 104, to make up for the imperfections and losses.

The pressure, temperature and liquid level of condenser 116 can be controlled by regulating the influx and egress of seawater 126 for the condenser 116. Regulation is achieved by incorporating into the system means for varying the pump 134 and motor 132 speeds. Alternatively, regulation can be achieved by incorporating integrated fluid lines and valves, not shown, and/or variable displacement fluid motor and pump. An air pump 112 is used to trim the volume of non-condensibles present in the condenser 116.

Power plant controller 140 is operatively connected to temperature sensor 142 and valve 144. Temperature sensor 142 detects the temperature of the steam exiting the boiler 102 and transfers that information to controller 140. Depending on the temperature of the steam, controller 140 will regulate valve 144 to increase or decrease the flow of oxidant from oxidant tank 118 to boiler 102.

Power plant controller 140 is also operatively connected to alternator 110 and by-pass valve 146. The frequency produced by alternator 110 is sensed by controller 140. Depending on the sensed frequency, temperature and programmed mission requests, controller 140 regulates valve 146 to increase or decrease the amount of working fluid being pumped to boiler 102 to control system 100 power output.

Figure 4:
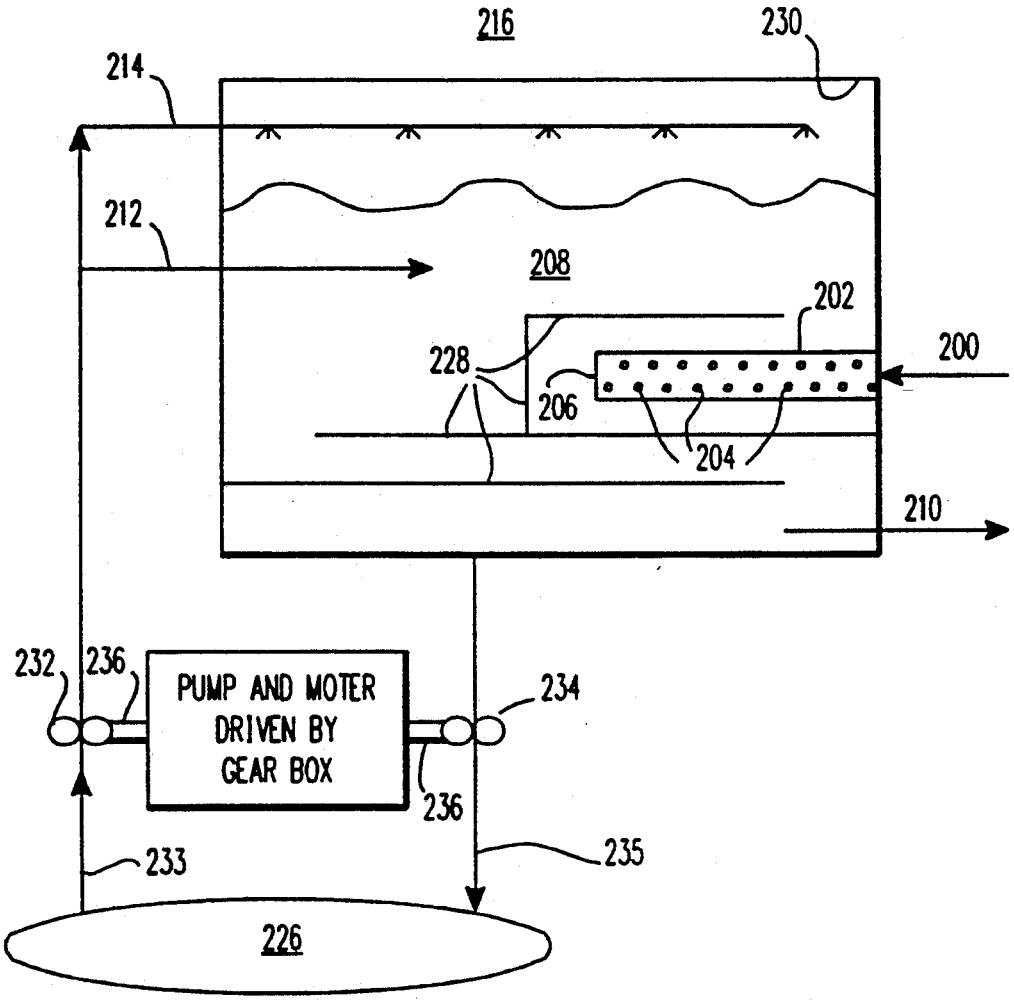
FIG. 4 is a schematic representation of an alternate condensing means to be used with the propulsion system of FIG. 3.

FIG. 4 shows an alternative embodiment of a mixing condenser subsystem 216. In the alternative embodiment, exhausted steam from the turbine enters condenser 230 by means of inlet 200. As an example, the steam then enters bubble device 202 where it is exhausted through openings 204. End cap 206 ensures that the steam exits bubble device 202 through openings 204.

A pool of water 208 is provided in condenser cavity 230 and surrounds bubble device 202. Baffles 228, shown as an example, are provided around bubble device 202 to adequately mix the steam bubbles released from bubble device at the water pool 208. Water working fluid is supplied to the feed water pump 114 from condenser subsystem 216 through outlet 210.

The water coolant injection and removal system of condenser subsystem 216 is generally the same as that for condenser 116. Ambient water 226 is introduced into condenser 230 by means of motor 232 and inlet line 233. Water is expelled to the ambient sea 226 by means of pump 234 and outlet line 235. Motor 232 and pump 234 may be mounted on a common shaft 236. The water coolant injection system of condenser subsystem 216 may differ from that of condenser 116 by providing a direct water inlet 212 into condenser 230 in addition to or in replace of the injection nozzles 214.

Figure 5:
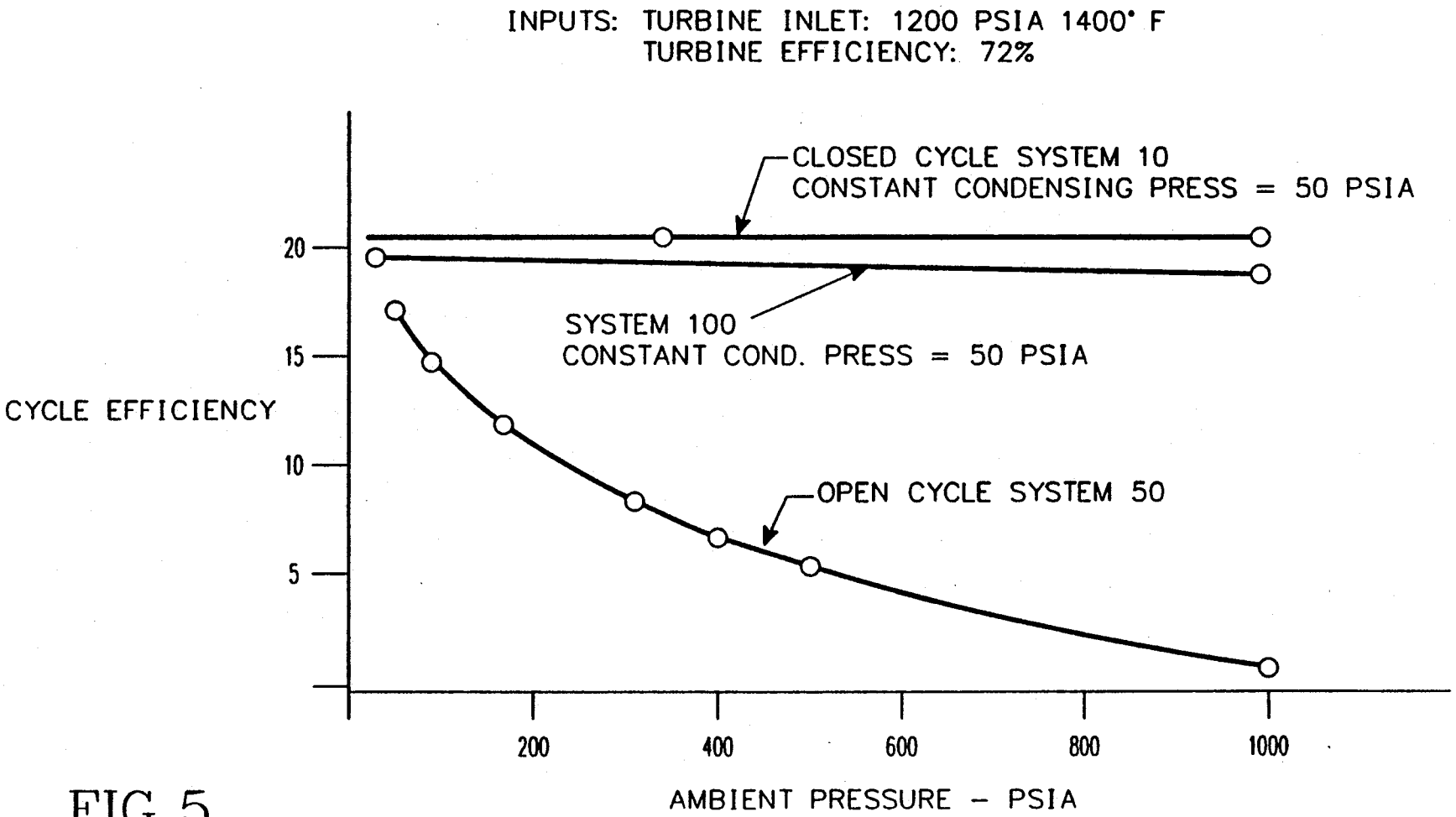
FIG. 5 is a graph which compares the overall cycle efficiencies for the propulsion systems of FIGS. 1, 2, and 3.

A comparison of overall efficiencies for system 100, open Rankine system 50 and closed Rankine system 10 is shown in FIG. 5. FIG. 5 shows that the thermodynamic performance of system 100 is nearly identical to the closed cycle system 10 for a wide range of operational depths. Yet, system 100 can achieve the same higher power generation as the open system 50. In addition, because it does not require excessive hull surface area for the condenser, high powered system 100 can replace the propulsion system of current torpedoes.

Utilizing the unique regenerative mixing condenser 116 subsystem for a given torpedo configuration can provide the means of achieving power generation and power density an order of magnitude greater than possible with the closed cycle system. Power generation is increased by obviating the heat rejection limits inherent in a vehicle which employs closed cycle system 10. Power density, that is the ratio of power to volume, is increased by maintaininq high overall cycle efficiency independent of operational depth.

The use of the present invention in system 100 improves cycle efficiency because greater pressure ratio and available energy are provided across the turbine 104 of the present invention 100 than in the open cycle system 50. Constant turbine 104 backpressure, which permits high, constant turbine 104 efficiency, is provided independent of operational depth. In addition, reheating of the boiler 102 feed water is provided by the exhaust steam of turbine 104. Thus, the present system 100 partially regenerates its waste heat.

The present system 100 offers negligible depth sensitivity and can decrease the need for stored propellants. The present system 100 can reduce the need of heat transfer area in the boiler 102 and provide a simpler control system. The pressure and temperature of condenser 116 can be controlled by the seawater 126 coolant flow rate.

Preferably, start-up water may be provided in the propulsion system 100 prior to the initial operation of the system. This start-up water may be provided by conventional means such as an injection tank. Alternatively, the start-up water storage may be designed into the boiler or mixing condenser subsystem.

In the foregoing specification certain preferred practices and embodiments of this invention have been set out, however, it will be understood that the invention may be otherwise embodied within the scope of the following claims.

I claim:

1. A drive system for an underwater vehicle utilizing an open Rankine thermodynamic cycle system having water as a working fluid comprising:

(a) steam generation means for receiving said working fluid and converting said working fluid to steam;

(b) an energy converter adapted to receive said steam and drive a propulsion means;

(c) a mixing condenser adapted to receive said steam exiting said energy converter and condense said steam to a liquid;

(d) means for introducing water into said mixing condenser from a source external to said Rankine cycle, said water mixing with said working fluid to form mixed working fluid;

(e) means for expelling a portion of said mixed working fluid from said mixing condenser to said external source; and (f) circulation means to feed a portion of said mixed working fluid from said mixing condenser to said steam generator means.

2. The drive system of claim 1 wherein said means for expelling comprises a discharge line and a pump provided in said discharge line.

3. The drive system of claim 2 wherein said means for introducing water into said mixing condenser comprises an inlet line and a motor provided in said inlet line.

4. The drive system of claim 3 further comprising a shaft provided between said motor and said pump wherein said motor provides at least a portion of the energy requirements of said pump.

5. The drive system of claim 4 wherein said shaft is operatively connected to said propulsion means.

6. The drive system of claim 1 further comprising means provided in said mixing condenser for directing said introduced water into said steam to condense at least a portion of said steam.

7. The drive system of claim 6 wherein said means for directing said introduced water into said steam comprises means to inject droplets of said introduced water into said steam exiting said energy converter.

8. The drive system of claim 7 further comprising baffles provided in said mixing condenser.

9. The drive system of claim 1 further comprising means provided in said mixing condenser for directing said steam into said mixed working fluid to condense said steam.

10. The drive system of claim 9 wherein said means for directing said steam comprises means to release bubbles of steam into a pool of mixed working fluid.

11. The drive system of claim 10 wherein said means to release bubbles comprises a hollow tube through which said steam flows, said tube provided in a pool of mixed working fluid, and a plurality of openings provided in said tube to release said steam into said pool of mixed working fluid.

12. The drive system of claim 11 further comprising baffles provided in said mixing condenser.

13. The drive system of claim 1 wherein said steam generator means is a liquid metal combustion boiler.

14. The drive system of claim 13 further comprising an oxidant tank which supplies said boiler with an oxidizing agent.

15. The drive system of claim 14 wherein said oxidant is $SF_6$ and said liquid metal is lithium.

16. The drive system of claim 14 further comprising an oxidant heater wherein a portion of said steam exiting said energy converter is used to preheat said oxidant in said oxidant tank.

17. The drive system of claim 16 further comprising first control means for regulating the flow of oxidant from said oxidant tank to said boiler.

18. The drive system of claim 17 wherein said first control means comprises a temperature sensor provided in said system before said energy converter to measure the temperature of said steam, a controller which receives the output of said temperature sensor and first valve means provided between said oxidant tank and said boiler, said first valve means regulated by said controller to adjust the flow of oxidant to said boiler.

19. The drive system of claim 16 further comprising second control means for regulating the temperature of said oxidant in said oxidant tank.

20. The drive system of claim 19 wherein said second control means comprises a temperature sensor provided in said oxidant tank and second valve means provided in said system after said energy converter, said second valve means regulated by said temperature sensor to adjust the flow of steam from said energy converter to said oxidant tank.

21. The drive system of claim 1 further comprising third control means for regulating the flow of working fluid in said system.

22. The drive system of claim 21 wherein said third control means comprises an alternator connected to said propulsion means, a controller which senses the frequency produced by said alternator and a by-pass valve regulated by said controller, said by-pass valve positioned in said cycle to allow a portion of said working fluid to by-pass said steam generation means and said energy converter.

23. The drive system of claim 1 wherein said circulation means comprises a feedwater pump provided in said system, said feedwater pump adapted to pump working fluid from said mixing condenser to said steam generation means, said feedwater pump adapted to be driven by said propulsion means.

24. The drive system of claim 1 wherein said underwater vehicle is a torpedo.

25. The drive system of claim 1 wherein said propulsion system is adapted to replace an existing propulsion system.

26. The drive system of claim 1 wherein said means for introducing water and said means for expelling water are regulated to maintain a desired temperature and pressure in said mixing condenser.

27. The drive system of claim 1 wherein said energy converter is a turbine.

28. A condenser assembly for use on an open Rankine thermodynamic cycle drive system having a steam generator and an energy converter driven by steam produced in said steam generator comprising:

(a) a mixing condenser adapted to receive said steam and condense said steam to a liquid;

(b) means for introducing water into said mixing condenser from a source external to said drive system; and (c) means for expelling a mixture of said liquid and said water from said mixing condenser to said external source.

29. The condenser of claim 28 wherein said means for expelling comprises a discharge line and a pump provided in said discharge line.

30. The condenser assembly of claim 29 wherein said means for introducing water into said mixing condenser comprises an inlet line and a motor provided in said inlet line.

31. The condenser assembly of claim 30 further comprising a shaft provided between said motor and said pump wherein said motor provides at least a portion of the energy requirements of said pump.

32. The condenser assembly of claim 31 wherein said energy converter is adapted to drive a propulsion means and said shaft is operatively connected to said propulsion means.

33. The condenser assembly of claim 30 further comprising means provided in said mixing condenser for directing said introduced water into said steam to condense said steam.

34. The condenser assembly of claim 33 wherein said means for directing said introduced water into said steam comprises means to inject droplets of said introduced water into said steam exiting said energy converter.

35. The condenser assembly of claim 34 further comprising baffles provided in said mixing condenser.

36. The condenser assembly of claim 30 further comprising means provided in said mixing condenser for directing said steam into said mixture of said liquid and said water to condense said steam.

37. The condenser assembly of claim 36 wherein said means for directing said stem comprises means to release bubbles of steam into a pool of said mixture of said liquid and said water.

38. The condenser assembly of claim 37 wherein said means to release bubbles comprises a hollow tube through which said steam flows, said tube provided in said pool of said mixture of said liquid and said water, and a plurality of openings provided in said tube to release said steam into said pool of said mixture of said liquid and said water.

39. The condenser assembly of claim 38 further comprising baffles provided in said mixing condenser.

* * * * *